US009593472B2

(12) United States Patent
Ye et al.

(10) Patent No.: US 9,593,472 B2
(45) Date of Patent: Mar. 14, 2017

(54) DRAIN PLUG LINKAGE DEVICE

(71) Applicants: XIAMEN LOTA INTERNATIONAL CO., LTD., Xiamen (CN); LA VIDA INDUSTRIAL CO., LTD., Xiamen (CN)

(72) Inventors: Liming Ye, Xiamen (CN); Yan Zhang, Xiamen (CN); Jianping Zhou, Xiamen (CN)

(73) Assignees: XIAMEN LOTA INTERNATIONAL CO., LTD., Xiamen (CN); LA VIDA INDUSTRIAL CO., LTD., Xiamen (CN)

( * ) Notice: Subject to any disclaimer, the term of this patent is extended or adjusted under 35 U.S.C. 154(b) by 0 days.

(21) Appl. No.: 14/692,900

(22) Filed: Apr. 22, 2015

(65) Prior Publication Data

US 2015/0299995 A1 Oct. 22, 2015

(30) Foreign Application Priority Data

Apr. 22, 2014 (CN) ..... 2014 1 01617206

(51) Int. Cl.
*E03C 1/23* (2006.01)

(52) U.S. Cl.
CPC ..... *E03C 1/2302* (2013.01)

(58) Field of Classification Search
CPC ..... E03C 1/2302; E03C 1/2306; A47K 1/14
USPC ..... 4/684, 685, 690–692, 295
See application file for complete search history.

(56) References Cited

U.S. PATENT DOCUMENTS 484,423 A * 10/1892 Hale ..... E03C 1/23 4/691
948,033 A * 2/1910 Alingham ..... E03C 1/23 4/689
1,597,459 A * 8/1926 Muend ..... E03C 1/23 4/691
1,848,521 A * 3/1932 Fleck ..... E03C 1/23 4/692

(Continued)

FOREIGN PATENT DOCUMENTS

DE 556241 C * 8/1932 ..... E03C 1/23
DE 2946073 A1 * 5/1981 ..... E03C 1/23

OTHER PUBLICATIONS

Machine Translation for DE '241.*
Machine Translation for DE '073.*

*Primary Examiner* — Erin Deery
(74) *Attorney, Agent, or Firm* — Daniel J. Chalker; Edwin S. Flores; Chalker Flores, LLP

(57) ABSTRACT

A drain plug linkage device (100) comprises a pull rod assembly (10) including a pull rod (1) and a link rod (2) operatively connected with each other; a lever member (3); and an engagement mechanism (6). One of the link rod (2) and the lever member (3) comprises a plurality of through-holes (21) and has the engagement mechanism (6) slidably mounted thereon, and the other one of the link rod (2) and the lever member (3) is configured to be inserted through one of the through-holes (21) and includes a plurality of axially-spaced circumferential ridges (32) and recesses (33) defined between the circumferential ridges (32). The engagement mechanism (6) is configured, when sliding into a position of engaging with the recess (33), to prevent the other one of the link rod (2) and the lever member (3) from being axially displaced with respect to the through-hole (21).

13 Claims, 17 Drawing Sheets

(56) References Cited

U.S. PATENT DOCUMENTS

| | | | | | |
|---|---|---|---|---|---|
| 3,263,243 | A | * | 8/1966 | Doyle | A47K 1/14 4/689 |
| 3,453,667 | A | * | 7/1969 | Politz | E03C 1/23 4/295 |
| 4,192,026 | A | * | 3/1980 | Williams | E03C 1/23 4/673 |
| 4,218,785 | A | * | 8/1980 | Crawford | E03C 1/232 4/295 |
| 4,807,306 | A | * | 2/1989 | Hayman | E03C 1/232 4/692 |
| 4,903,943 | A | | 2/1990 | Hochstrasser | |
| 6,061,847 | A | | 5/2000 | Jourdan | |
| 8,136,179 | B2 | | 3/2012 | Li | |

* cited by examiner

Section F-F

Section G-G

Section H-H

Section I-I

DRAIN PLUG LINKAGE DEVICE

FIELD OF THE INVENTION

The present invention relates particularly to the technical field of drain, particularly to a drain plug linkage device for example for bathroom, tub, washbasin or hand-washing sink, and more particularly to a drain plug linkage device which can be assembled and adjusted rapidly.

PRIORITY CLAIM AND CROSS-REFERENCE TO RELATED APPLICATIONS

This patent application claims priority to Chinese patent application 2014101517206 filed on Apr. 22, 2014, the entire contents of which are incorporated herein by reference.

BACKGROUND OF THE INVENTION

A water discharger, also referred to as a drain device, is proposed for storing or discharging water in containers such as bathroom, tub, washbasin or hand-washing sink. Such drain device is generally in form of a drain plug linkage device. For instance, in a prior drain device, the container is in communication with a drainpipe through an outlet, a drain plug is disposed adjacent to the outlet and connected with one end of an operating rod such as a lever member, and the other end of the lever member is connected with a pull rod member extending downwards, so as to move the drain plug between positions of closing and opening the outlet by operating the pull rod member, realizing water storage or discharge in the containers like bathroom pool, tub, washbasin or hand-washing sink.

A number of the drain devices, namely drain plug linkage devices, have been known in the prior art.

For example, U.S. Pat. No. 4,903,943 discloses a linkage mechanism for a discharge valve, in which a spherical part is fixed on a lever member such that the lever member can perform lever motion with the spherical part as a pivot point. The lever member is connected at one end with a pull rod member via a connecting member, and at the other end with a drain plug, while the connecting member at one end is pivotally and undetachably connected with the lever member by means of a pin, and at the other end is secured to a position of the pull rod member by means of a screw, such that operative connection between the pull rod member and lever member is realized, so as to perform opening or closing movement of the drain plug by moving the pull rod member upwards or downwards. It is fairly difficult to assemble such a linkage mechanism, since a number of small components have to be mounted in narrow space. Furthermore, the connecting member is prone to rust, which will be detrimental to operation of the linkage mechanism. Moreover, the pull rod member of the linkage mechanism is in substantially rigid connection, which causes difficulty in transition from vertical lift movement of the pull rod to vertical lift movement of the drain plug via lever action. In addition, difficulty occurs in mounting a locking nut by means of which the spherical part is directly and pivotably mounted in a pipe body of the discharge valve.

U.S. Pat. No. 6,061,847 discloses a linkage assembly for a drain stopper, including an elongated connector bar with a plurality of apertures at its upper and lower ends, a stem having a J-shaped portion, a lever arm, and a drain stopper having an aperture, wherein the J-shaped portion of the stem is received in a selected aperture at the upper end of the connector bar, one end of the lever arm is inserted in a selected aperture at the lower end of the connector bar, and the other end of the lever arm is inserted in the aperture of the drain stopper. The linkage assembly is operated with a higher degree of freedom and assembled more easily, as compared with that of U.S. Pat. No. 4,903,943. However, no positioning effect is provided by the connection among the J-shaped portion of stem, the apertures of connector bar and the lever arm in the linkage assembly, such that effective opening and closing movement of the drain stopper perhaps cannot be realized by said linkage assembly.

U.S. Pat. No. 8,136,179 B2 discloses a drain stopper linkage assembly, including a lift rod, a connecting bar, a pivot rod and a drain stopper, wherein bottom end of the lift rod forms an engagement part, upper end of the connecting bar has an engagement groove for the engagement part being engaged and fixed, and the engagement part has a greater dimension than the engagement groove. The connecting bar has a plurality of holes, an end of the pivot rod is provided with a concave arc fixed portions for tying in with the plurality of holes, and a convex arc portion disposed between two said fixed portions, and outer diameter of the end of the pivot rod is slightly larger than inside diameter of the holes of the connecting bar. In the drain stopper linkage assembly, the connecting bar is connected with the lift rod and the pivot rod both by snapping a greater-size inserting component to a smaller-size receiving component, which improves accuracy of positioning. However, a considerable force needs to be overcome for disengaging such snapping connection, which results in difficulty in disengaging the lift rod from the connecting bar, and accordingly results in difficulty, e.g. in adjusting positions of the connecting bar relative to the pivot rod, meanwhile it causes wear of components in the linkage assembly easily and shortens service life of the linkage assembly. Moreover, a spherical body of the pivot rod in the linkage assembly is still directly mounted in a pipe via a locking nut, causing difficulty of assembly in the limited space.

Therefore, there is need to improve the prior drain plug linkage devices, with advantages of simple and reliable assembly and disassembly, easy adjustment and reliable operation of the drain plug linkage device.

SUMMARY OF THE INVENTION

It is thus the object of the present invention to provide a drain plug linkage device which can solve at least some of the aforesaid technical problems.

According to an aspect of the present invention, a drain plug linkage device is provided, comprising: a drain plug; a pull rod assembly including a pull rod and a link rod operatively connected with each other; a lever member having a first end operatively connected with the link rod and a second end configured to operate the drain plug; and an engagement mechanism. One of the link rod and the lever member comprises a plurality of through-holes and has the engagement mechanism slidably mounted thereon, and the other one of the link rod and the lever member is configured to be inserted through one of the through-holes and includes a plurality of axially-spaced circumferential ridges and recesses defined between the circumferential ridges. The engagement mechanism is configured, when sliding into a position of engaging with the recess, to prevent the other one of the link rod and the lever member from being axially displaced with respect to the through-hole.

In the drain plug linkage device of the present invention, the relative position of the lever member and the link rod can be adjusted in a simple and convenient way, and it also can be securely retained by simple engagement of the engagement mechanism into the recess. Meanwhile, the vertical movement of the pull rod assembly can be effectively converted to the lever motion of the lever member about a pivot point, e.g., lever motion of a spherical portion, so as to operate the drain plug to open or close a piping member.

In a preferred embodiment, the link rod includes the plurality of through-holes and has the engagement mechanism slidably mounted thereon. The lever member is configured to be inserted through one of the through-holes and includes the plurality of the circumferential ridges and the recesses. The engagement mechanism is configured, when sliding along the link rod into the position of engaging with the recess, to prevent the lever member from being axially displaced with respect to the through-hole. Such an arrangement facilitates manufacturing of the link rod, lever member and engagement mechanism.

Preferably, the through-hole has a greater size than the first end of the lever member, to facilitate adjustment of the relative position of the link rod with respect to the lever member.

In a preferred embodiment, the lever member has at least one longitudinal ridge, which permits smoothly slidable adjustment of the link rod along the lever member. Not only can the vertical movement of the pull rod assembly be effectively converted to the lever motion of the lever member, but also rotation of the lever member around longitudinal axis of the link rod can be reduced or avoided, such that an angle adjustment can be reduced or avoided when assembling the link rod.

In a particularly preferred embodiment, the longitudinal ridge comprises a vertically longitudinal ridge and a horizontally longitudinal ridge forming a cross-shaped cross section, so as to define a pair of top recesses and a pair of bottom recesses between two adjacent circumferential ridges. The cross-shaped cross section permits smoothly slidable adjustment of the link rod along the lever member. Not only can the vertical movement of the pull rod assembly be effectively converted to the lever motion of the lever member, but also rotation of the lever member around longitudinal axis of the link rod can be effectively avoided. Such rotation is usually considered as a factor in instability of the linkage device. At the same time, the angle adjustment can be effectively avoided when assembling the link rod.

In a specific embodiment, the engagement mechanism comprises a rear wall, a front wall, two side walls, and a longitudinal through-hole defined between the walls. The link rod is configured to be inserted through the longitudinal through-hole.

In a further preferred embodiment, the rear and front walls of the engagement mechanism have a first opening and a second opening, respectively. The rear wall is arranged away from the second end of the lever member and engages into the recess. As a result, the engagement mechanism is allowed to smoothly slide along the link rod.

In a particularly preferred embodiment, the first opening of the rear wall defines a pair of first engagement sides with a smaller distance there between, and a pair of second engagement sides with a greater distance there between. The engagement between the engagement sides of the engagement mechanism with the recesses of the lever member, especially with the pair of top recesses defined by the cross-shaped longitudinal ridge and circumferential ridge, allows the vertical movement of the pull rod assembly to be effectively converted to the lever motion of the lever member. Moreover, especially the arrangement that the rear wall is arranged away from the second end of the lever member, and the shape of the first opening of the rear wall allows the vertical movement of the pull rod assembly to be further effectively converted to the lever motion of the lever member when the engagement mechanism engages with the lever member.

More preferably, a pair of snapping protrusions is arranged at the lower portion of the pair of second engagement sides. Advantageously, snapping the pair of snapping protrusions into the pair of bottom recesses defined by the cross-shaped longitudinal ridge and circumferential ridge allows the more secure engagement between the engagement mechanism and the lever member. Meanwhile, owing to the configuration and size of the snapping protrusions, the secure engagement can be realized without much effort.

In an embodiment, the link rod has a pair of longitudinally arranged tracks, and the rear wall of the engagement mechanism forms a concave feature which defines a first guiding channel and a second guiding channel for receiving the pair of tracks in the longitudinal through-hole, which effectively guides the engagement mechanism.

In another embodiment, the link rod comprises an elastic stopping member for preventing the engagement mechanism from being detached, which provides a solution to prevention of dropping-off and loss of the relatively smaller engagement mechanism.

In another preferred embodiment, the drain plug linkage device further comprises a pivot assembly having a sleeve means and a spherical portion pivotably arranged in the sleeve means, wherein the spherical portion is fixedly attached to or integrated with the lever member between the first end and the second end of the lever member.

In yet another preferred embodiment, the spherical portion has a pair of substantially vertical planes, and the sleeve means has corresponding flat sections. In addition or as an alternative to the engagement of the longitudinal ridge and engagement side, the arrangement of the planes in the spherical portion allows to avoid rotation of the lever member around the longitudinal axis of the link rod, while still enabling the vertical movement of the pull rod assembly to be effectively converted to the lever motion.

In a further preferred embodiment, the drain plug linkage device further comprises an elastically deformable snapping means fixedly attached to or integrated with the pivot assembly, which facilitates assembling and disassembling of the pivot assembly.

Preferably, the snapping means comprises a pair of elastically deformable tabs, each having a flange and a press portion.

According to another aspect of the present invention, a drain plug linkage device is provided, comprising: a drain plug; a pull rod assembly; a lever member having a first end operatively connected with the link rod, and a second end configured to operate the drain plug; a pivot assembly mounted in a receiving port of a pipe, wherein the pivot assembly comprises a sleeve means and a spherical portion pivotably arranged in the sleeve means, the spherical portion being fixedly attached to or integrated with the lever member between the first end and the second end of the lever member; and an elastically deformable snapping means fixedly attached to or integrated with the pivot assembly, wherein the snapping means comprises a flange for engaging with a cut-out or an indention of the pipe.

In the drain plug linkage device of the present invention, it is not required to use a locknut in a limited space for mounting and supporting the pivot point of the lever member, i.e. the spherical portion. Instead, the spherical portion and its support arrangement is provided in form of an assembly. Consequently, simple assembling and disassembling is provided by simply snapping the assembled pivot assembly into the receiving port of the pipe with the elastic transformation of the snapping means.

In a preferred embodiment, the snapping means comprises a pair of elastically deformable tabs, each having the flange and a press portion.

In yet another aspect of the present invention, a method of assembling or disassembling the drain plug linkage device is further provided.

The additional features and advantages of the present invention will partially become apparent to those skilled in the art upon reading the disclosure, and the others will be described in the following embodiments with reference to the accompanying drawings.

The present invention is described in detail below with reference to the accompanying drawings.

BRIEF DESCRIPTION OF THE DRAWINGS

The above and further advantages of the invention may be better understood by referring to the following description in conjunction with the accompanying drawings, in which.

Figure 1:
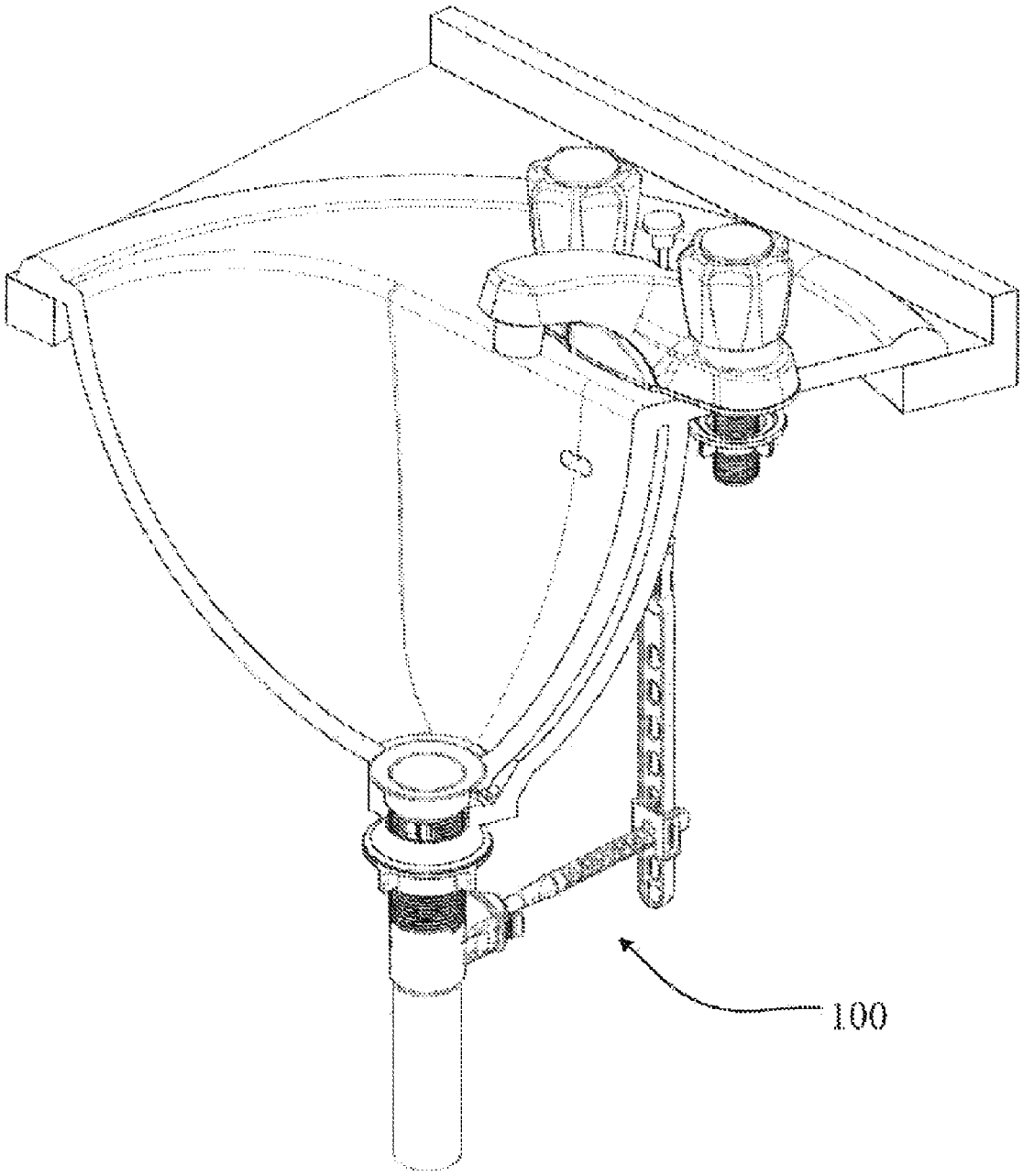
FIG. 1 shows a partially sectional perspective view of a washbasin suitable for use with a drain plug linkage device in accordance with an embodiment of the present invention.

In the present invention, same or similar reference signs represent same or similar features.

DETAILED DESCRIPTION OF THE INVENTION

For a better understanding of the features, objects and effects of the present invention, the specific embodiments of the present invention will be described with reference to the figures. Although the figures are provided to represent some embodiments of the present invention, the figures are not required to be drawn in scale, and some features can be enlarged, removed or cross-sectioned to better illustrate and explain the disclosure of the present invention. The term "in the drawing" or similar terms used in the description do not necessarily refer to all the accompanying drawings or examples.

Some directional terms, such as "top", "bottom", "left", "right", "upwards", "downwards", used herein for describing the accompanying drawings will be understood to have their normal meaning and will refer to those directions as the drawings are normally viewed, and shall not be interpreted as a restriction to technical solutions in the appended claims.

The term "about" or "approximately" used herein will be understood by the person skilled in the art and will vary to some extent depending upon the context in which it is used.

FIG. 1 shows a household appliance, and particularly, a washbasin, as a container, and accessories thereof. Such a washbasin is generally equipped with a faucet, like those being provided with a pair of faucet handles for dispensing cold water and hot water respectively, and a drain plug linkage device 100 (also known as a "drain device") according to an embodiment of the present invention, as illustrated in FIG. 1. The drain plug linkage device 100 is applicable to the washbasin as illustrated in FIG. 1, so as to be operated by a user to close or open a drain port of a drain pipe with a drain plug disposed adjacent thereto. Although in the illustrated embodiment the drain plug linkage device 100 of the present invention is used with the washbasin, it is conceivable to incorporate the linkage device into various containers, such as tubs, bathrooms, hand-washing basins or other household appliances, in which water storage and discharge is needed. It should be understood by the person skilled in the art that various applications incorporated with the drain plug linkage device of the present invention are covered within the scope of the present invention. Other configurations of the washbasin or other containers are not critical to the present invention, but can be selected by the person skilled in the art as required, which will not be detailed herein. The drain plug linkage device 100 of the present invention will be described below.

Figure 2:
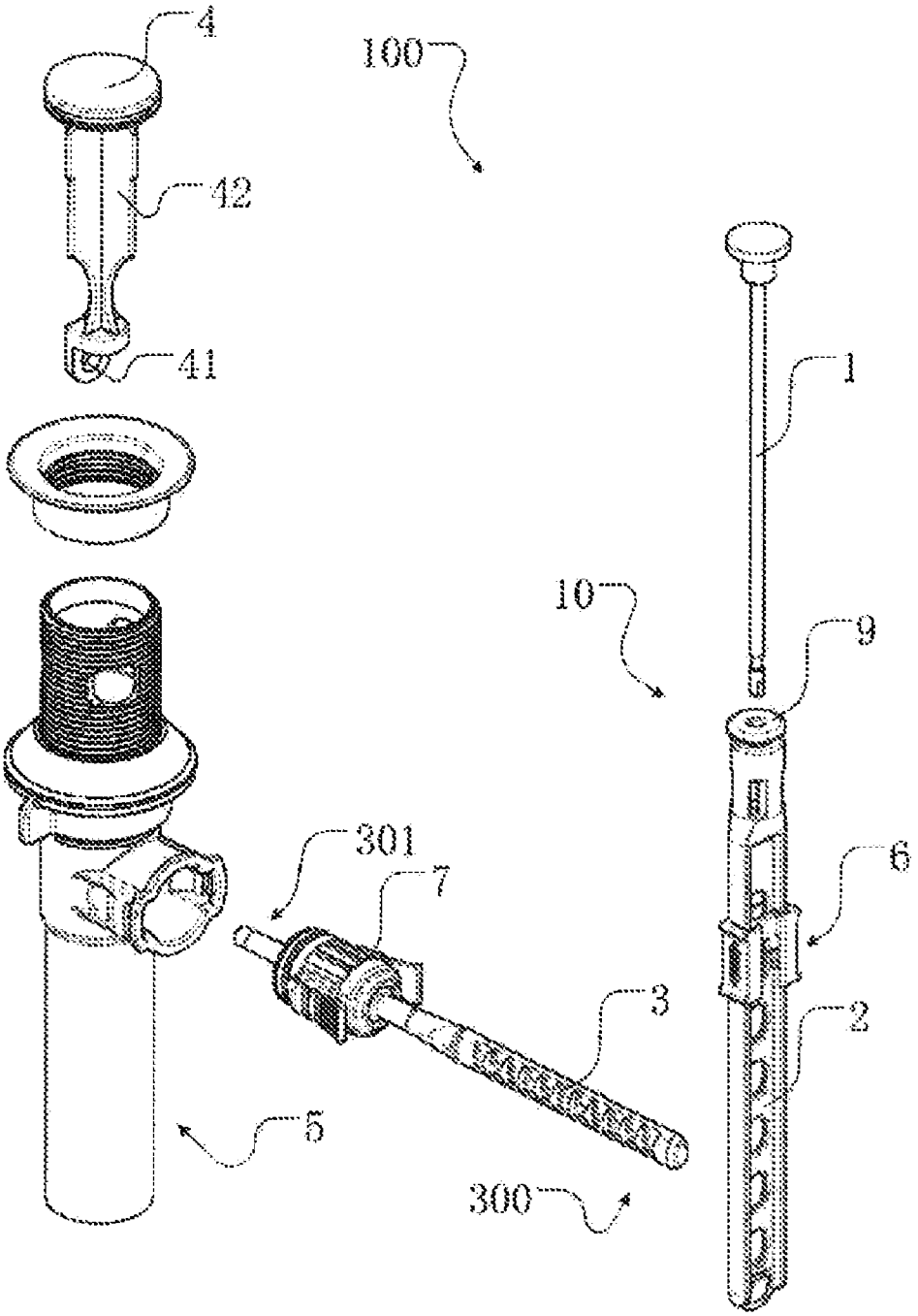
FIG. 2 shows a partially exploded view of a drain plug linkage device in accordance with an embodiment of the present invention.
Figure 3:
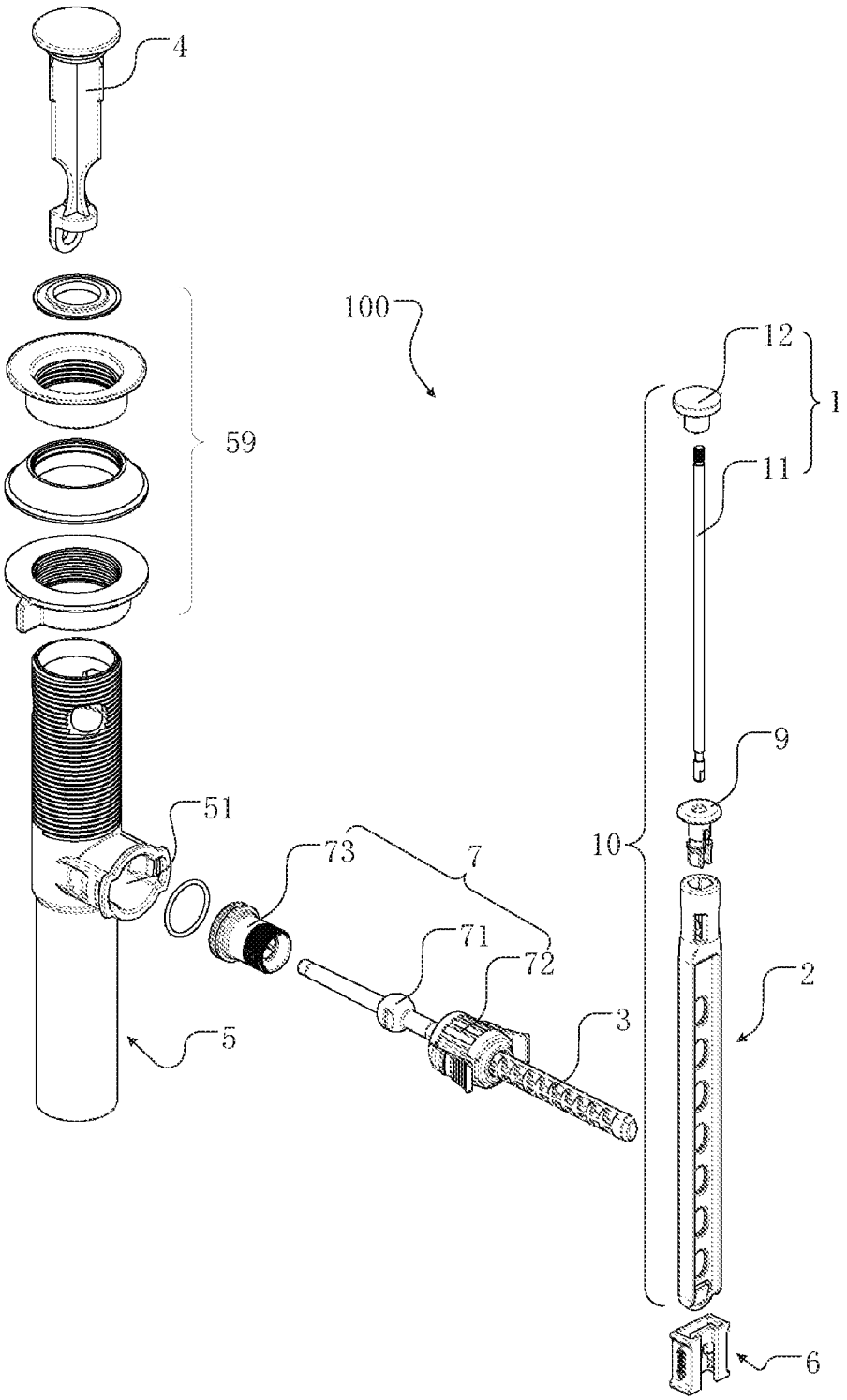
FIG. 3 shows a complete exploded view of a drain plug linkage device in accordance with an embodiment of the present invention.
Figure 4:
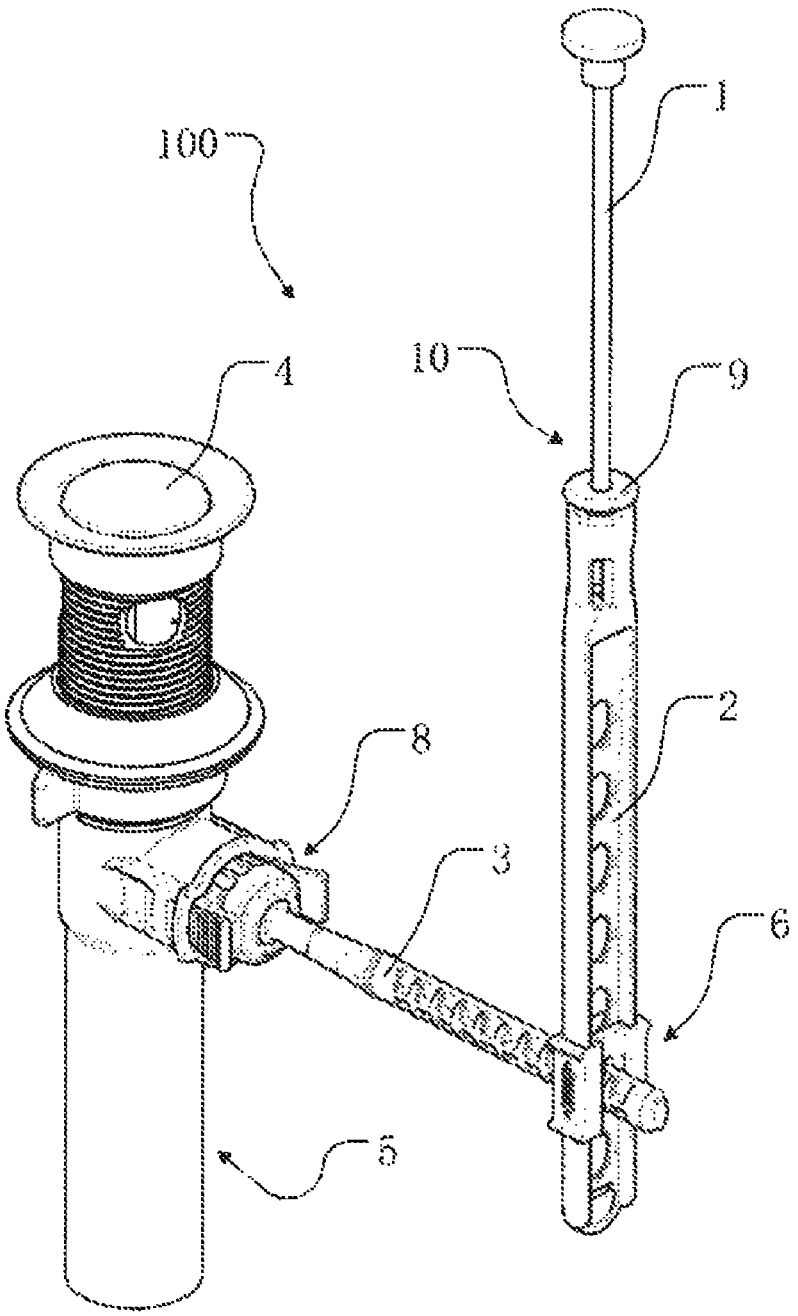
FIG. 4 shows a perspective view of an assembled drain plug linkage device in accordance with an embodiment of the present invention.
Figure 5:
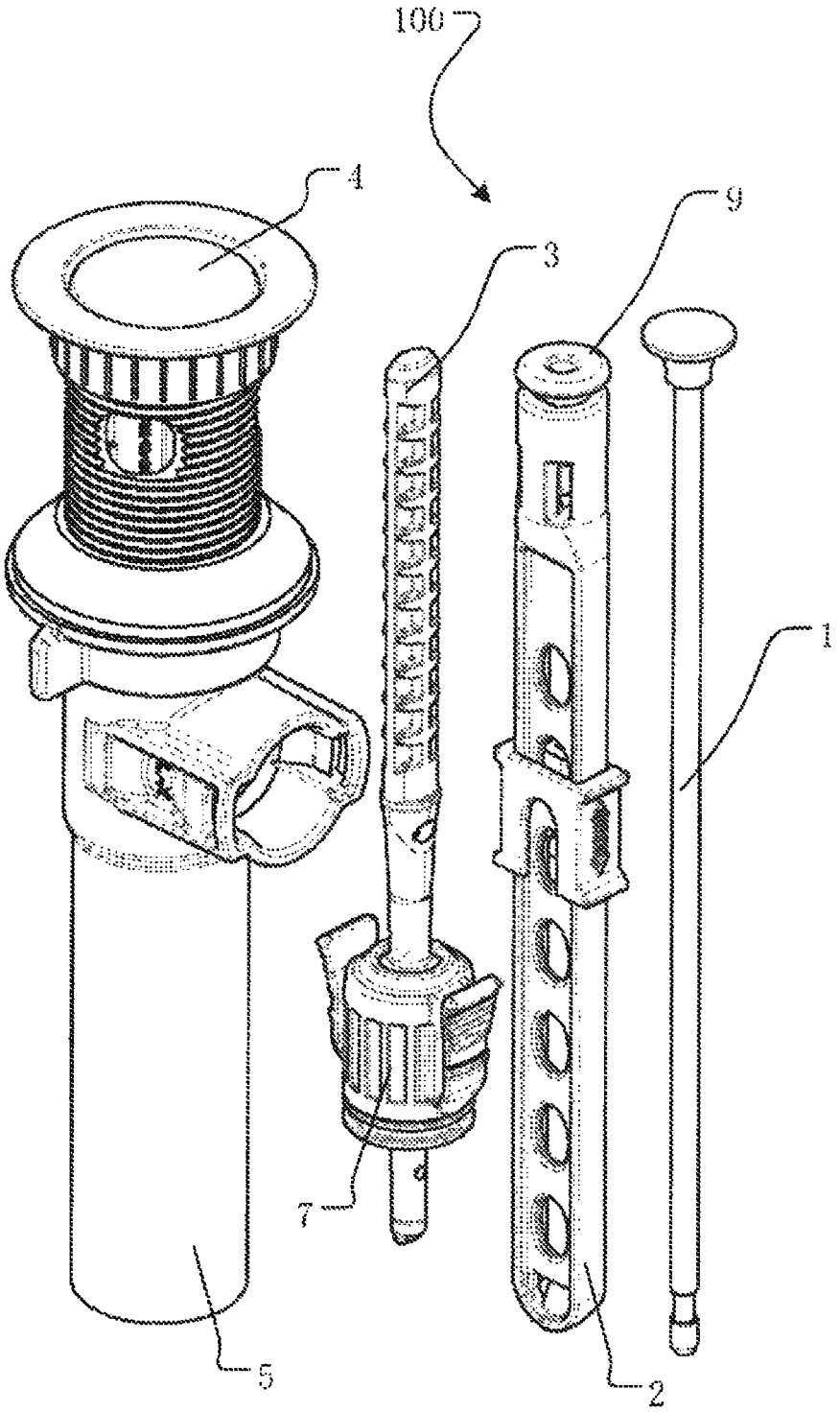
FIG. 5 shows a perspective view of components of a partially assembled drain plug linkage device in accordance with an embodiment of the present invention.
Figure 6:
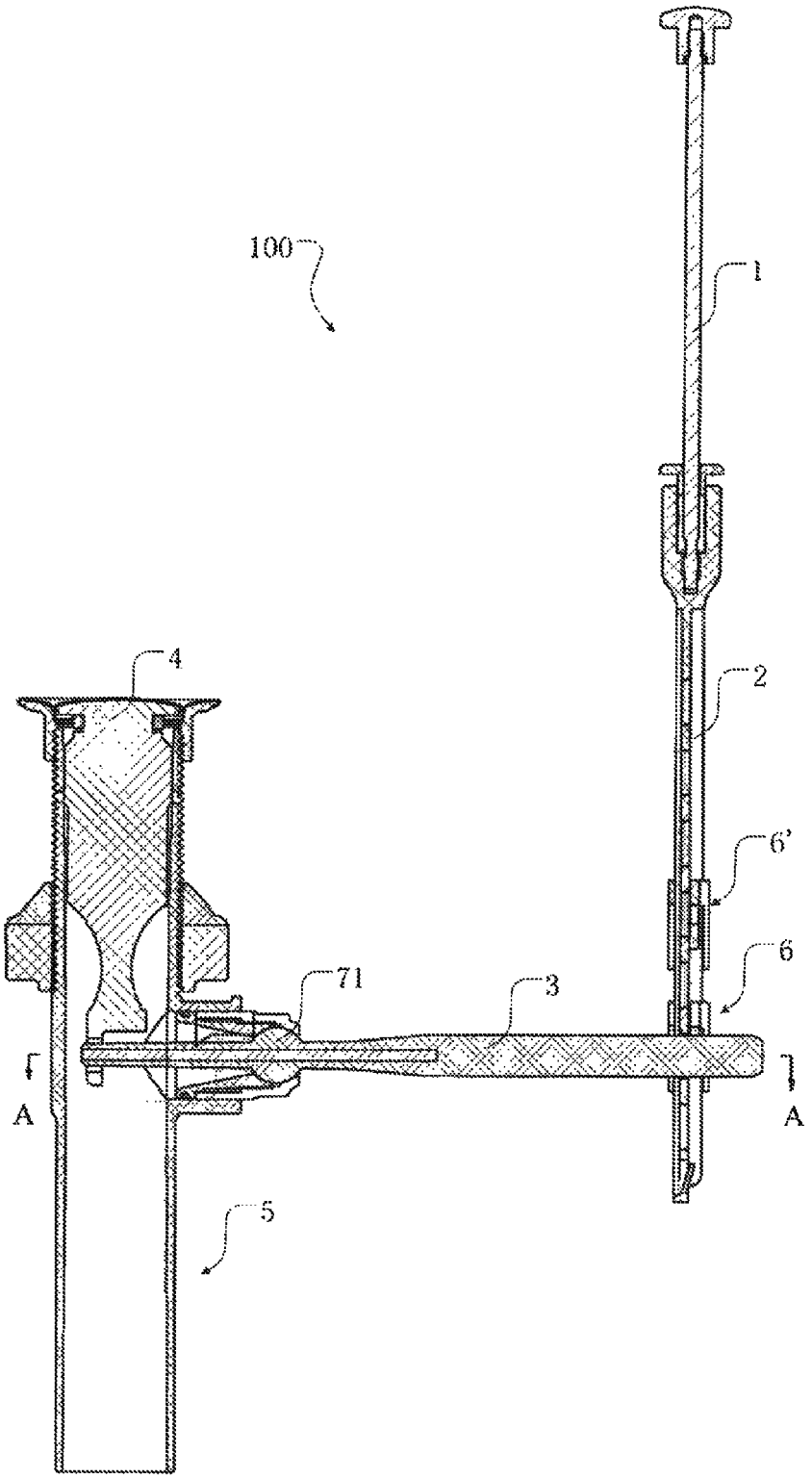
FIG. 6 shows a sectional view of a drain plug linkage device in accordance with an embodiment of the present invention, with an elastic snapping means being not completely snapped into a pipe.
Figure 7:
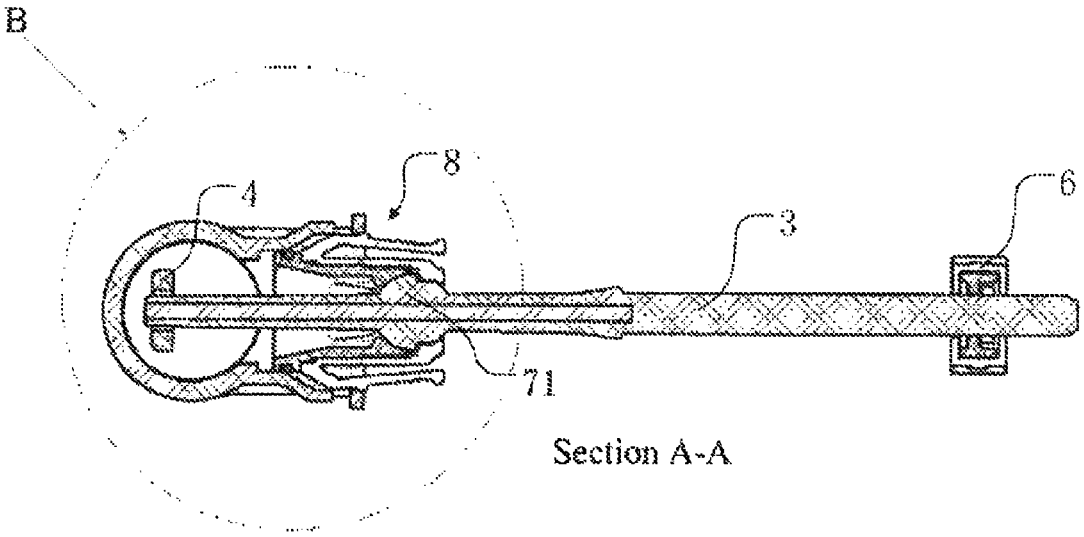
FIG. 7 shows a sectional view taken along the line A-A of FIG. 6.
Figure 8:
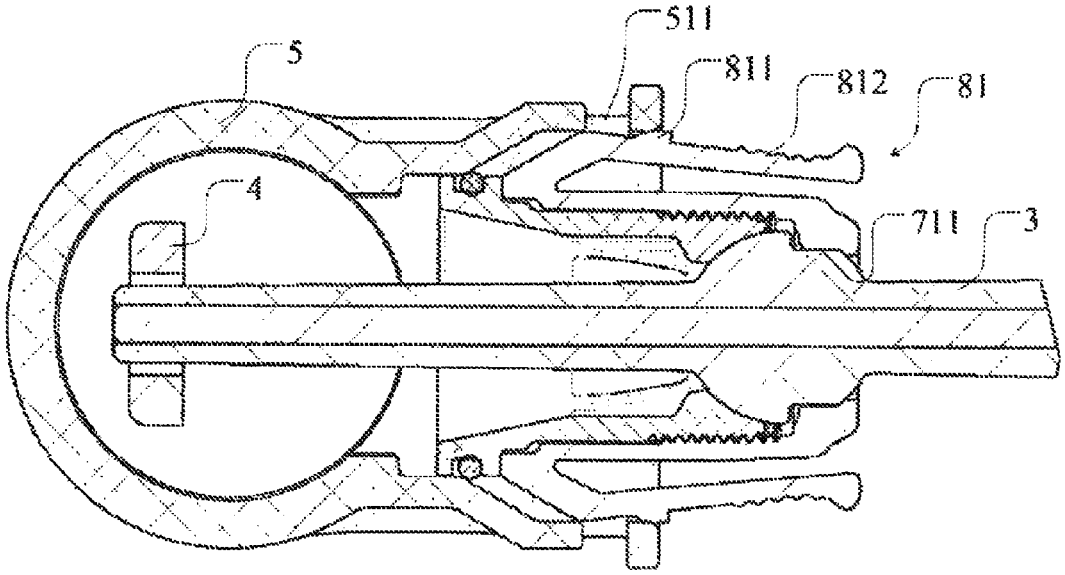
FIG. 8 shows a partially enlarged sectional view of part B of FIG. 7, illustrating an elastic snapping means being not completely snapped into a pipe.
Figure 19A:
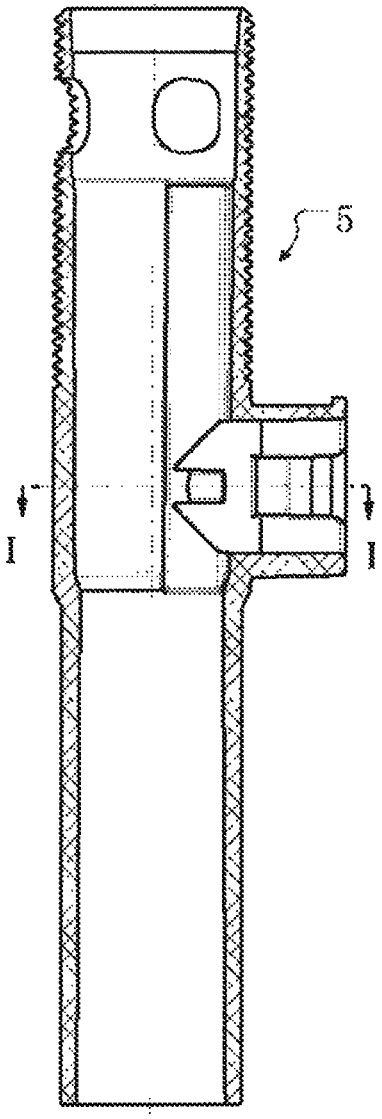
FIGS. 19A-C show a pipe.
Figure 19B:
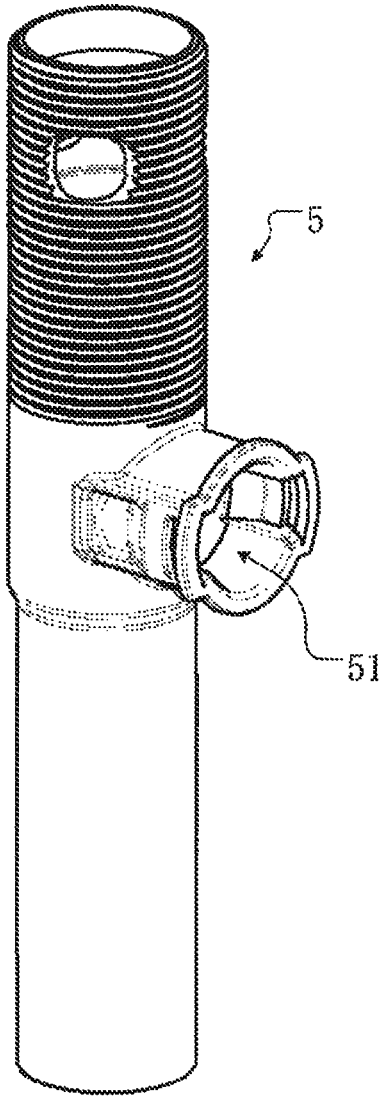
Figure 19C:
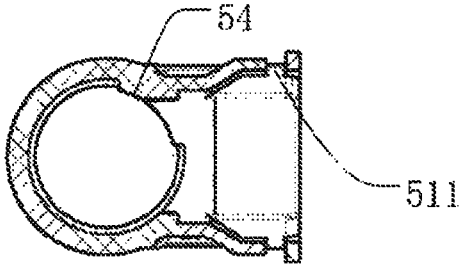

Referring to FIGS. 2 to 6, the drain plug linkage device 100 according to the present invention is generally shown, which mainly comprises a drain plug 4 (also usually known as "rocket") at least partially disposed in a pipe body 5, such as a drainpipe, and configured to open or close a port of the pipe body 5, a lever member 3 and a pull rod assembly 10. As shown in FIGS. 2 and 3, the pipe body 5 may comprise one or more sealing members 59 for mounting the pipe body to a washbasin or the like. Still referring to FIGS. 2 and 3, the drain plug 4 may comprise an aperture 41 and, preferably a reinforcement rib 42. The pipe body 5 may be correspondingly provided with positioning protrusions 54 (FIG. 19), so as to cooperate with the reinforcement rib 42 for advantageously positioning the drain plug 4 in the pipe body 5.

Figure 9:
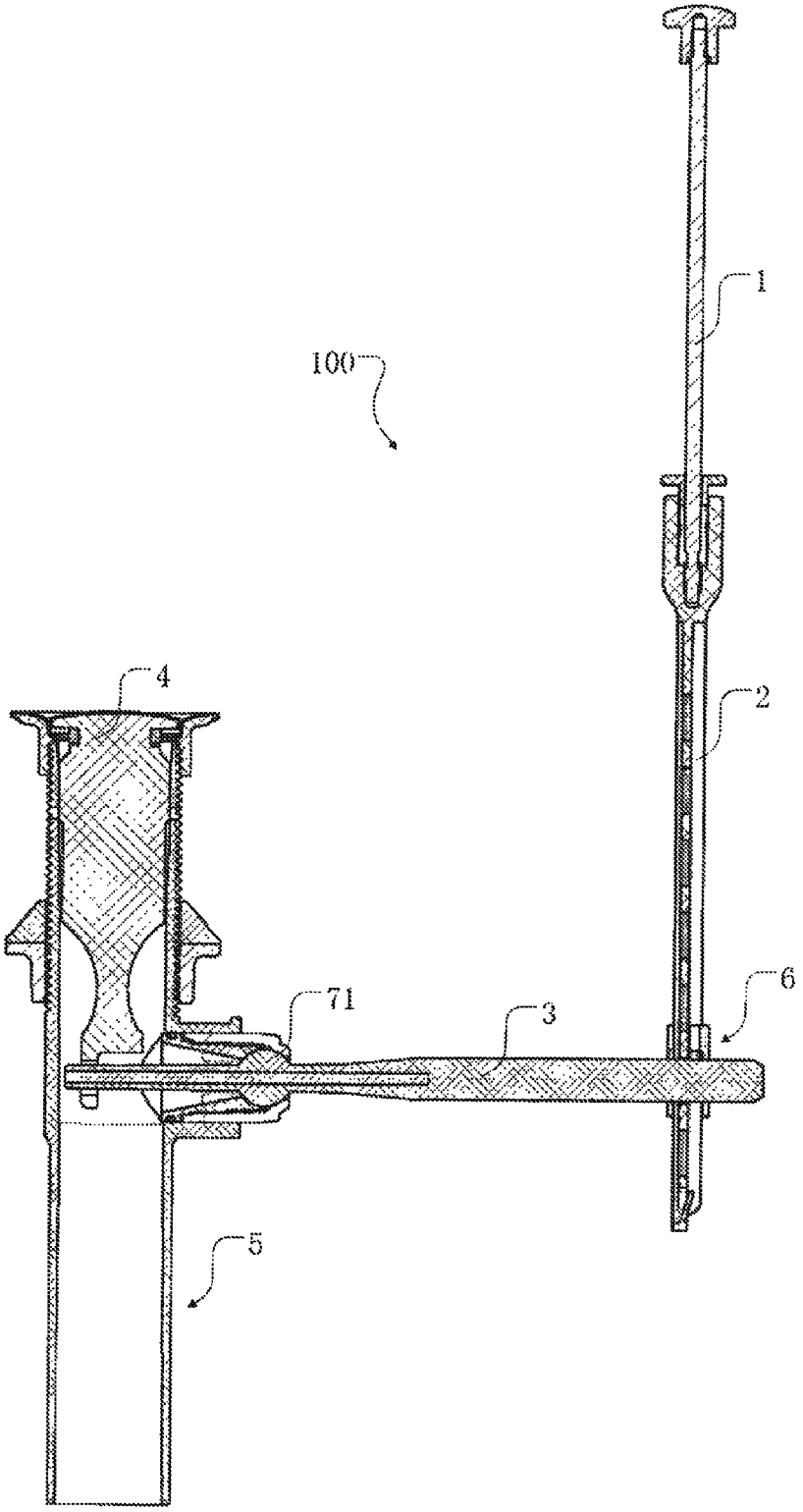
FIG. 9 shows a sectional view of a linkage device in accordance with an embodiment of the present invention, with an elastic snapping means being snapped into a pipe.
Figure 10:
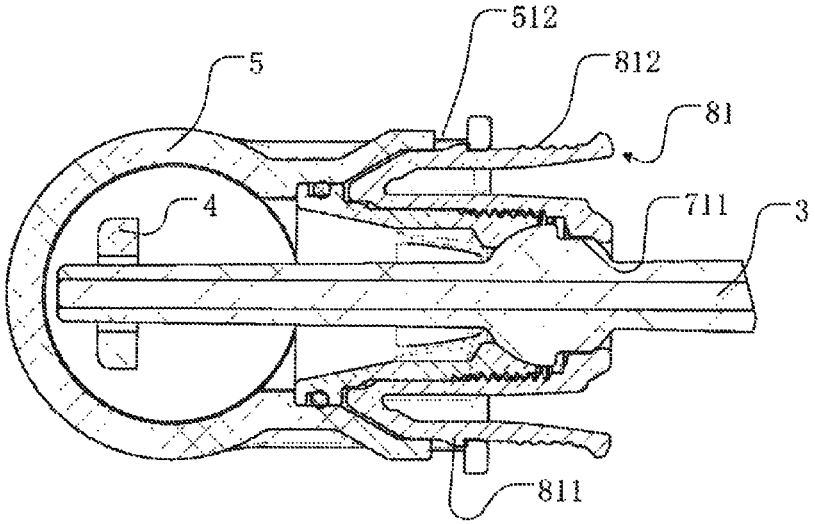
FIG. 10 shows a partially enlarged sectional view substantially corresponding to FIG. 8, illustrating an elastic snapping means snapped into a pipe.
Figure 11:
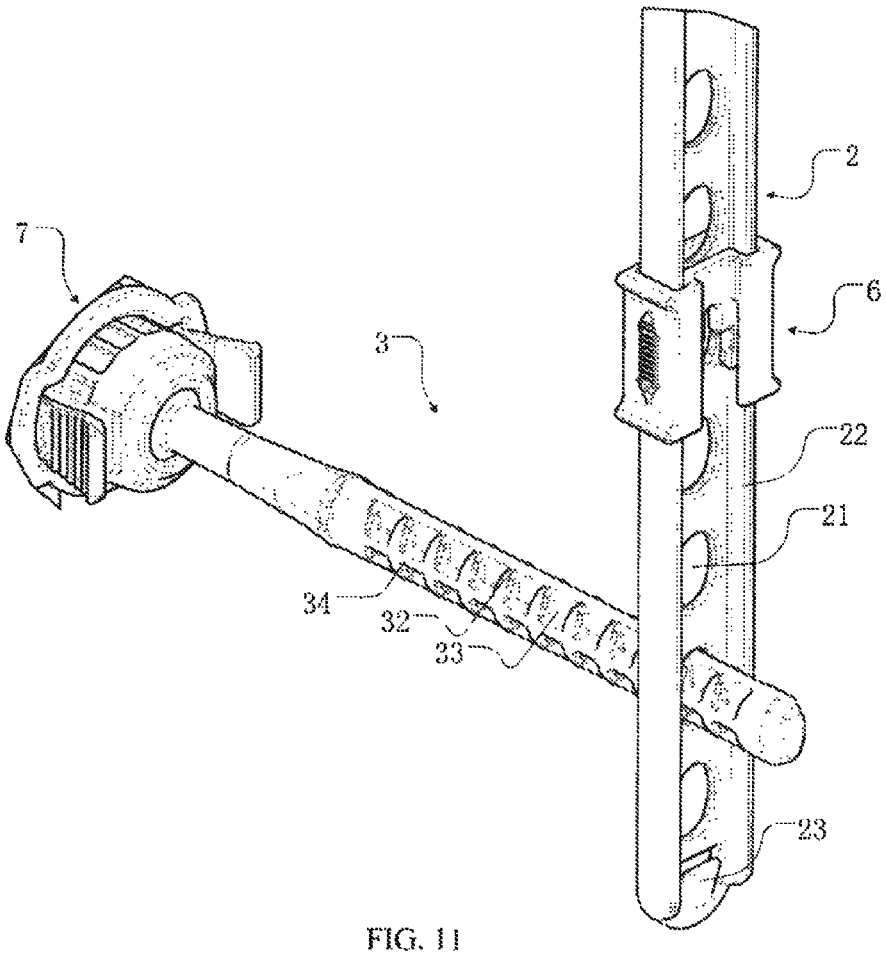
FIG. 11 shows a partial perspective view of a drain plug linkage device in accordance with an embodiment of the present invention, with a slidable engagement mechanism being not engaged with a lever member.
Figure 12:
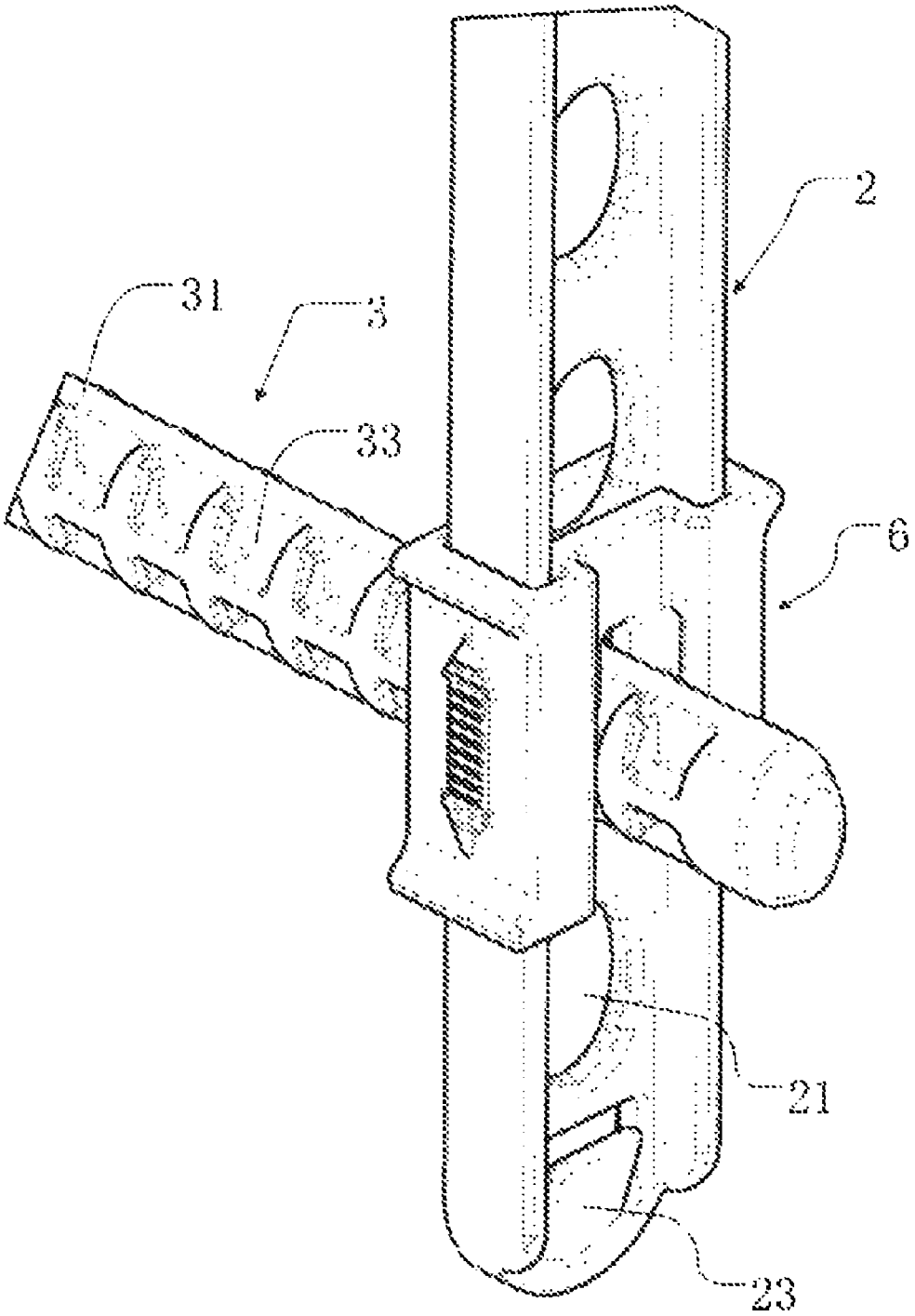
FIG. 12 shows a partial perspective view of a drain plug linkage device in accordance with an embodiment of the present invention, a slidable engagement mechanism being engaged with a lever member.

As shown in FIG. 2, the lever member comprises a first end 300 and a second end 301. The first end 300 of the lever member 3 is in operative connection with the pull rod assembly 10, and the second end 301 is configured to operate opening and closing of the drain plug 4, as shown in FIG. 9. In the illustrated embodiment, the second end 301 of the lever member 3 is inserted into an aperture 41 on the bottom of the drain plug 4. The aperture 41 has a greater size than the second end 301 of the lever member 3, such that the second end 301 and the aperture 41 are in loose-fit, while it still allows to perform opening and closing movement of the drain plug by means of the second end 301 when the lever member 3 acts a lever motion. It is conceivable of other fitting forms between the second end 301 and the aperture 41. For example, the second end is directly connected with a drain plug which does not have any aperture.

The pull rod assembly 10 according to the present invention will be described generally with reference to FIGS. 2-6. In the illustrated embodiment, the pull rod assembly 10 comprises a pull rod 1 which comprises a pull rod body 11 and a pull rod head 12, a link rod 2 and a pull rod connector 9. As particularly shown in FIGS. 3 and 17A-D, the link rod 2 is provided with a receiving portion 20 in form of a receptacle 24 at its top. As more particularly shown in FIG. 3, the pull rod connector 9 may have a central hole (not indicated) and is configured to snap into the receiving portion. The pull rod 1 at its bottom forms a snapping portion for snapping into the central hole. Specifically, the pull rod connector 9 may comprise atop flange (not indicated), and a pair of oppositely arranged and spaced elastic deformable portions (not indicated) extending from the top flange. Moreover, the receiving portion may comprise an expansion portion (not indicated) for expanding the central hole.

Consequently, when the pull rod 1 is connected with the link rod 2 by snapping, the pull rod connector 9 may snap into the receptacle 24 of the link rod 2, e.g., by means of press. The elastic deformable portions of the pull rod connector 9 now rest on the expansion portion without pressure acting thereon. Subsequently, the pull rod 1 is inserted into the central hole of the pull rod connector 9, and extend beyond the pair of elastic deformable portions, such that the connection between the pull rod 1 and link rod 2 is achieved by the pull rod connector 9. Optionally, when the pull rod 1 is being inserted, the pull rod connector 9 can be slightly pressed downwards, such that the elastic deformable portions are slightly expanded under the action of the expansion portion to facilitate the insertion of the pull rod 1. Accordingly, the pull rod 1 can reliably snap into the link rod 2 in a very simple way.

The pull rod 1 can be dismantled by e.g. pressing the pull rod connector 9, press it downwards against the expansion portion to expand the elastic deformable portions and thus the central hole by the expansion portion, and allowing the pull rod 1 to be detached from the link rod 2 and the pull rod connector 9 effortlessly. Afterwards, optionally, the elastic deformable portions are pushed close to each other to facilitate detaching the pull rod connector 9 from the receiving portion 20 of link rod 2. As an alternative, the pull rod connector 9 is unable to be detached, with different pull rods being inserted therein subject to different applications.

In this disclosure, an embodiment of the pull rod assembly 10 is disclosed in the co assigned pending U.S. patent application Ser. No. 14/246,684, which has been fully incorporated herein by reference, especially regarding the configuration of connection of the pull rod 1, pull rod connector 9 and link rod 2.

As an alternative, the present invention may cover the embodiments of other pull rod assemblies. For instance, the pull rod and link rod are connected in other manners or are integrated with each other, or the link rod per se is configured as a pull rod, which all falls within the scope of the present invention and may be combined with other inventive embodiments to obtain further embodiments.

The new configuration of operation and connection of the link rod 2 and lever member 3 according to the present invention, in particular by means of a slidable engagement mechanism 6 according to the present invention, will be described below with reference to the drawings.

Referring to FIGS. 2-6, 11-14, 15A-F, 16A-E and 17A-D, the lever member 3 comprises a first end 300 and a second end 301 (FIG. 2). The first end 300 of lever member 3 is operatively connected with the link rod 2, and the second end 301 is configured to operate the drain plug 4. As shown in the drawings, a spherical portion 71 of a pivot assembly 7 is integrally formed in the lever member 3 between the first end 300 and the second end 301, as detailed below.

Figure 16A:
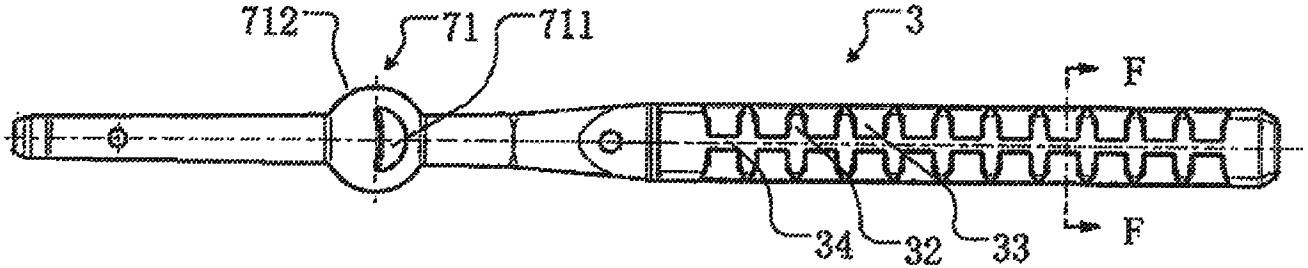
FIG. 16A shows a front view of a lever member in accordance with an embodiment of the present invention.
Figure 16B:
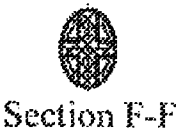
FIG. 16B shows a sectional view taken along the line F-F of FIG. 16A, illustrating a first and second longitudinal ridges forming a cross-shaped cross section.

Particularly referring to FIGS. 16A-E, the lever member 3 at its first end 300 may comprise a pair of first, vertically longitudinal ridges 31 and a pair of second, horizontally longitudinal ridges 34 extending along the axial direction, as well as a plurality of circumferential ridges 32 spaced in the axial direction. The pair of first, vertically longitudinal ridges 31 and the pair of second, horizontally longitudinal ridges 34 form a cross-shaped cross section, as shown in FIG. 16B. Due to the presence of ridges 31, 32 and 34, the lever member 3 at its first end 300 comprises recesses 33 defined by the ridges. In the illustrated embodiment, the lever member 3 comprises a pair of top recesses and a pair of bottom recesses.

Although the configurations of these ridges are shown in the illustrated embodiment, it could be conceivable for the person skilled in the art of any other suitable shapes or configurations of ridges. For example, the circumferential ridges 32 and/or the longitudinal ridges 31, 34 have other shapes of cross section; and/or there are only the circumferential ridges without the longitudinal ridges arranged. Although less preferred, only the circumferential ridges can well allow the engagement of the slidable engagement mechanism 6 to prevent the lever member 3 from being displaced along the axial direction with respect to through holes 21 of link rod 2, as described below.

Specifically as shown in FIG. 16B, the lever member 3 at its first end 300 has generally an oval cross section, with its horizontal size being smaller than its vertical size. Namely, the circumferential ridges 32 have oval cross section.

Figure 17A:
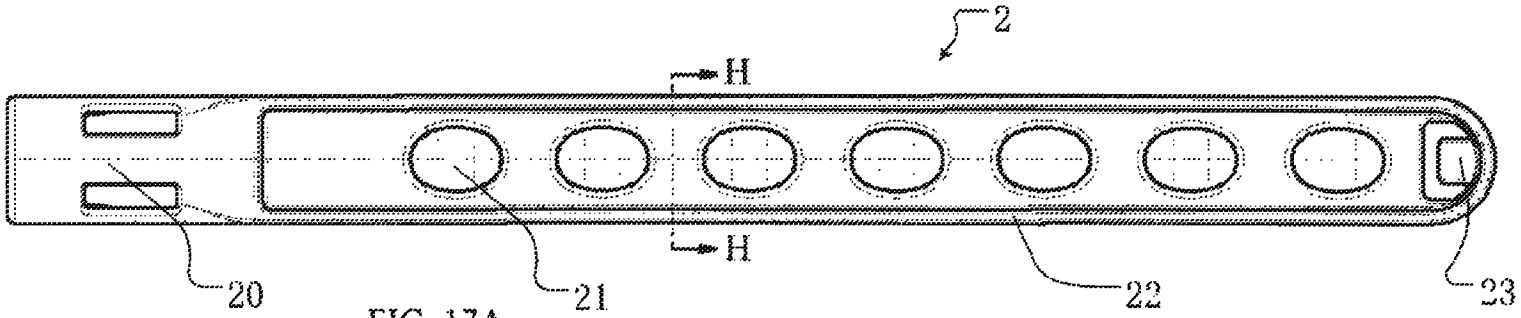
FIG. 17A shows a front view of a link rod in accordance with an embodiment of the present invention.
Figure 17B:
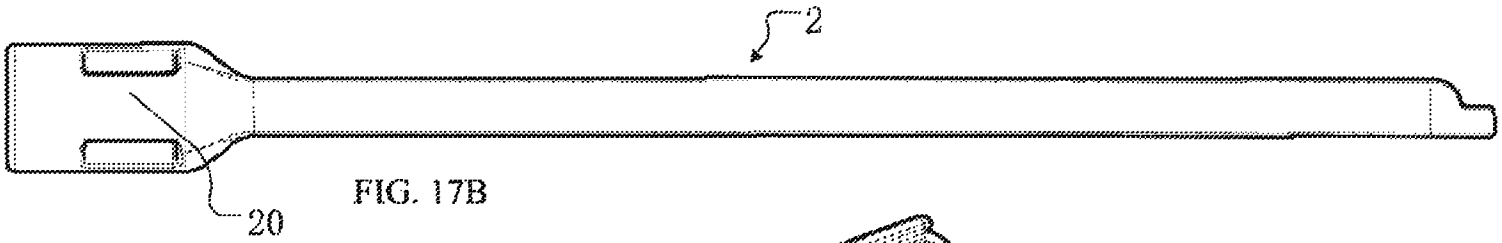
FIG. 17B shows a side view of a link rod in accordance with an embodiment of the present invention.
Figure 17C:
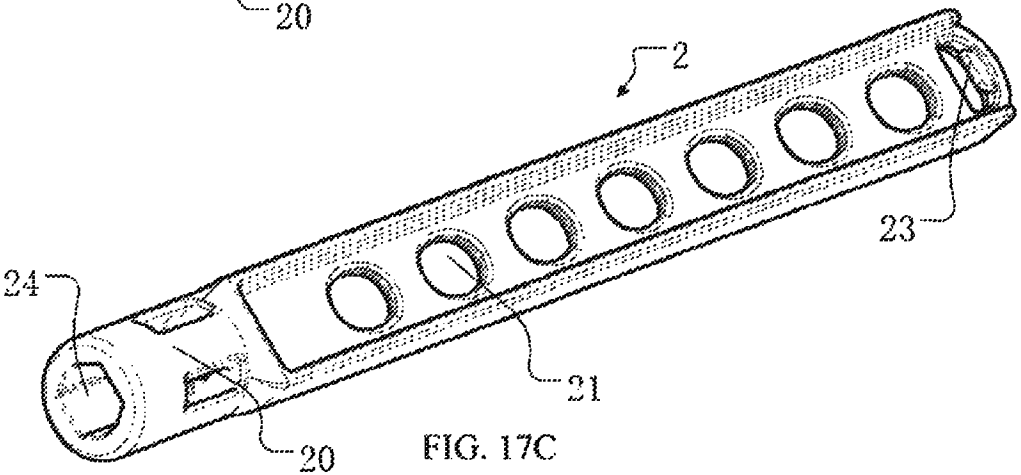
FIG. 17C shows a perspective view of a link rod in accordance with an embodiment of the present invention.

Referring to FIGS. 17A-D, the link rod 2 comprises a series of through-holes 21 arranged along the axial direction. In particular as shown in FIG. 17A, the through-holes 21 are correspondingly of oval shape, with the horizontal size being smaller than the vertical size. More preferably, the size of through-hole 21 is slightly greater than that of outer contour of the first end 300, i.e. of the circumferential ridges 32, of lever member 3, such that the first end 300 of lever member 3 can be smoothly inserted into one respective through-hole 21, and the lever member 3 is allowed to move along its axial direction with respect to the through-hole of the link rod 2 when the engagement mechanism 6 is not engaged (e.g. at the position labeled as 6' in FIG. 6).

Figure 17D:
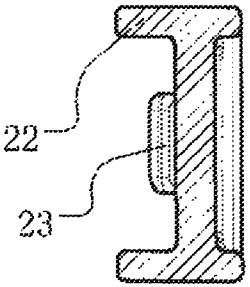
FIG. 17D shows a sectional view taken along the line H-H of FIG. 17A.

Particularly as shown in FIG. 17D, the link rod 2 may further comprise a pair of tracks 22 extending along the axial direction at the two sides of through-holes 21, such that the slidable engagement mechanism 6 is slidably mounted on the link rod 2, as described below. In addition, the link rod 2 at its terminal end may comprise a stopping member 23 in form of elastic deformable tab, for preventing the slidable engagement mechanism 6 from sliding out of the link rod 2. The stopping member 23 preferably extends from the end obliquely and outwardly with respect to the axial direction, such that the engagement mechanism 6 is allowed to conveniently slide onto the link rod 2 easily, but is not allowed to detach from the link rod 2 unless the stopping member 23 is being pressed.

Referring to FIGS. 15A-F, the slidable engagement mechanism 6 according to the embodiment of present invention is illustrated. The engagement mechanism 6 comprises a rear wall, a front wall, two side walls, and a longitudinal through-hole 66 defined between the walls. In the illustrated embodiment, the rear wall refers to the direction away from the drain plug, and the front wall refers to the direction close to the drain plug. However, it should be appreciated that the directional terms "front" and "rear" are not essential in the context, as long as they can be differentiated from the two side walls at the two sides of link rod 2. As shown in FIGS. 11 to 14, the link rod 2 is configured to be inserted through the longitudinal through-holes 66, such that the engagement mechanism 6 is slidably mounted on the link rod 2. As shown on FIG. 15D, the longitudinal through-hole 66 is sized to correspond to the cross section of link rod 2. In particular, the rear wall of engagement mechanism 6 forms a concave feature 60, so as to define, in the longitudinal through-hole 66, a first guiding channel 661 and a second guiding channel 662 for receiving the tracks 22 of the link rod 2, respectively.

Figures 15A, 15B, 15C, 15D, 15E, 15F:
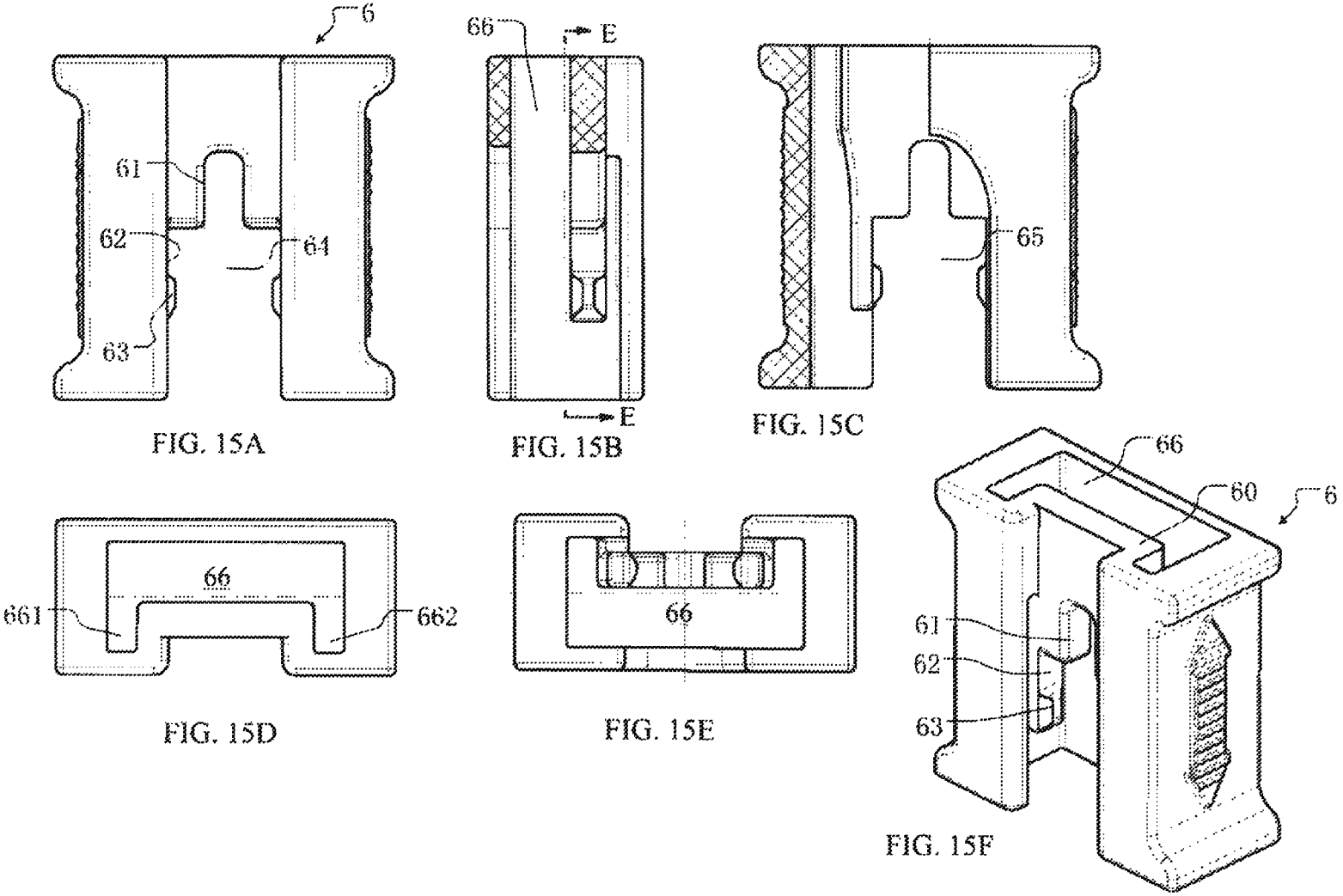
FIG. 15A shows a rear view of a slidable engagement mechanism in accordance with an embodiment of the present invention.
FIG. 15B shows a side sectional view of a slidable engagement mechanism in accordance with an embodiment of the present invention.
FIG. 15C shows a half sectional view of a slidable engagement mechanism in accordance with an embodiment of the present invention, taken along the line E-E of FIG. 15B.
FIG. 15D shows a top view of a slidable engagement mechanism in accordance with an embodiment of the present invention.
FIG. 15E shows a bottom view of a slidable engagement mechanism in accordance with an embodiment of the present invention.
FIG. 15F shows a perspective view of a slidable engagement mechanism in accordance with an embodiment of the present invention.

Still referring to FIGS. 15A-F, the rear wall and front wall of the engagement mechanism 6 comprise a first opening 64 and a second opening 65, respectively. Specifically as shown in FIG. 15A, the first opening 64 of the rear wall defines a first section with a smaller gap and a second section with a greater gap. The first section forms a pair of first engagement sides 61 for engaging with the vertically longitudinal ridge 31 of the lever member 3 at two sides. The second section forms a pair of second engagement sides 62 for engaging with the horizontally longitudinal ridge 31 of the lever member 3. As shown in FIG. 15B, the pair of second engagement sides 62 at its lower portion has a pair of snapping protrusions.

The adjustment of the relative position and operative connection between the lever member 3 and link rod 2 in accordance with the present invention is described below with reference to the drawings. In particular as shown in FIGS. 11-14, when the engagement mechanism 6 is at a non-engagement position e.g., labeled as 6' in FIG. 6, the vertical position of connection can be adjusted by inserting the first end 300 of lever member 3 into the through-holes 21 at different heights in the link rod 2, and the horizontal position of connection can be adjusted by axial movement of the first end 300 of lever member 3 with respect to the inserted through-hole 21 along the lever member 3. For instance, the vertical position (or vertical component) of connection between the lever member 3 and the link rod 2 is be adjusted varyingly from the uppermost to the lowermost through-holes 21, and the horizontal position (or horizontal component) is adjusted varyingly from the innermost to the outermost recesses 33 in the first end 300 of lever member 3 (and further the lever member 3 as a whole is mounted into the receiving port 51 of the pipe body 5 with the pivot assembly 7).

Figure 13:
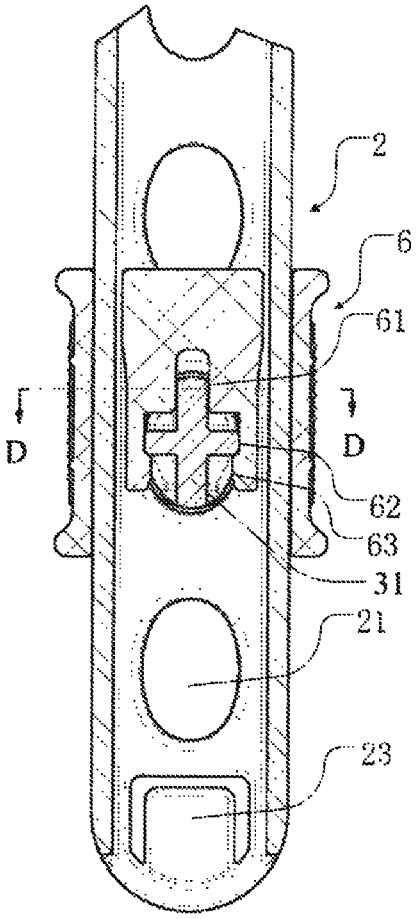
FIG. 13 shows a sectional view taken along the line C-C of FIG. 14.
Figure 14:
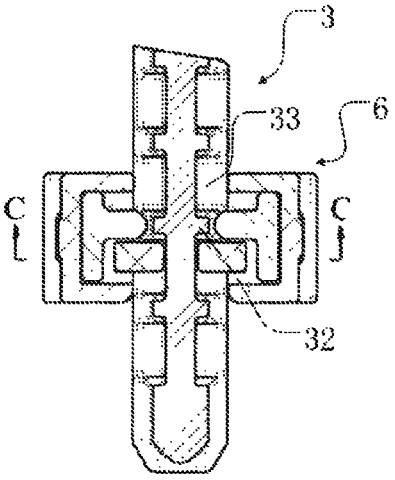
FIG. 14 shows a sectional view taken along the line D-D of FIG. 13.

When the adjustment of position is completed, the engagement mechanism 6, with its rear wall, slidingly engages into the corresponding recess 33 of lever member 3. In other words, as mentioned before, the first and second sections in the first opening 64 respectively engage with the longitudinal ridges laterally. Preferably, as shown in FIG. 13, the second section, i.e. the second engagement side 62, of the first opening 64 has a height greater than thickness of the horizontally longitudinal ridge 32, preferably with a gap left between the top of first section and the vertically longitudinal ridge 31, to allow the vertical movement of the link rod 2 to be converted to the pivot movement of the lever member 3. As shown in FIG. 13, the small snapping protrusions 63 at the lower portion of second engagement sides 62 are engaged in a pair of the bottom recesses 33. Although not that preferable, it is conceivable of providing no snapping protrusion, which means the engagement mechanism needs not to be deformed. In this case, the lever motion of the lever member 3 is driven by vertical movement of the link rod, with the axial movement of the lever member being limited by the circumferential ridges, and shaking of the lever member in the horizontal plane being prevented by the longitudinal ridge.

Accordingly, the operative connection between the lever member 3 and the link rod 2 by means of the slidable engagement mechanism 6 of the present invention allows the vertical movement of the pivot assembly to be effectively converted to the lever motion of the lever member. Moreover, the adjustment of position and engagement are very simple with less or no snapping force required.

In the illustrated embodiment, the link rod 2 comprises the through-holes on which the engagement mechanism 6 slides, and the lever member 3 comprises the ridges and recesses. Nevertheless, it could also be conceivable of a reverse configuration, which falls fall within the scope of the present invention.

The new pivot assembly 7 and elastic snapping means for assembling the pivot assembly 7 are described below with reference to the drawings.

Referring to FIGS. 2-10, 18A-D and 19A-C, the drain plug linkage device 100 according to the embodiment of present invention may comprise a pivot assembly 7 mounted into the receiving port 51 of the pipe body 5, usually transverse to the stem of the pipe body 5, and an elastically deformable snapping means 8 for securely mounting the pivot assembly 7 and thus the lever member 3 into the receiving port 51. The pivot assembly 7 comprises a sleeve means and a spherical portion 71 pivotably arranged in the sleeve means, wherein the spherical portion 71 is integrated with the lever member 3 as mentioned before. Alternatively, the spherical portion 71 can be also fixedly attached to the lever member 3. The sleeve means comprises a pivot sleeve 72 and a fastening sleeve 73 that respectively contact against the spherical portion 71 at two ends. As illustrated, the pivot sleeve 72 and fastening sleeve 73 are fastened to each other by means of a pivot sleeve thread 722 and a fastening sleeve thread (not indicated).

Figure 16C:
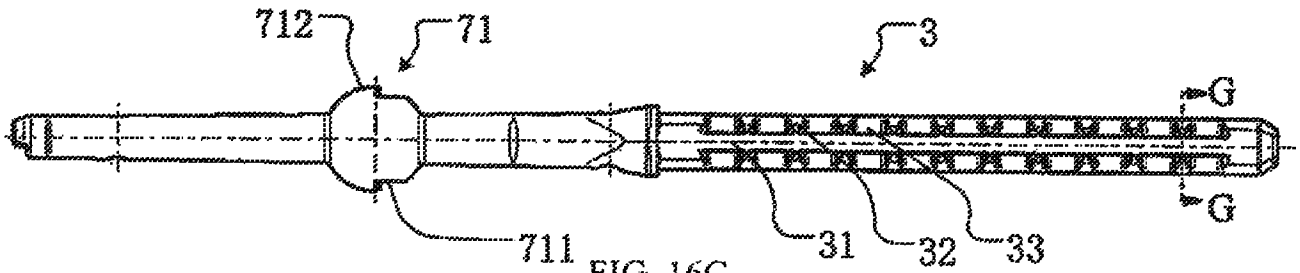
FIG. 16C shows a top view of a lever member in accordance with an embodiment of the present invention.
Figure 16D:
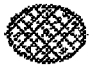
FIG. 16D shows a sectional view taken along the line G-G of FIG. 16C, illustrating the cross section of the circumferential ridges.
Figure 16E:
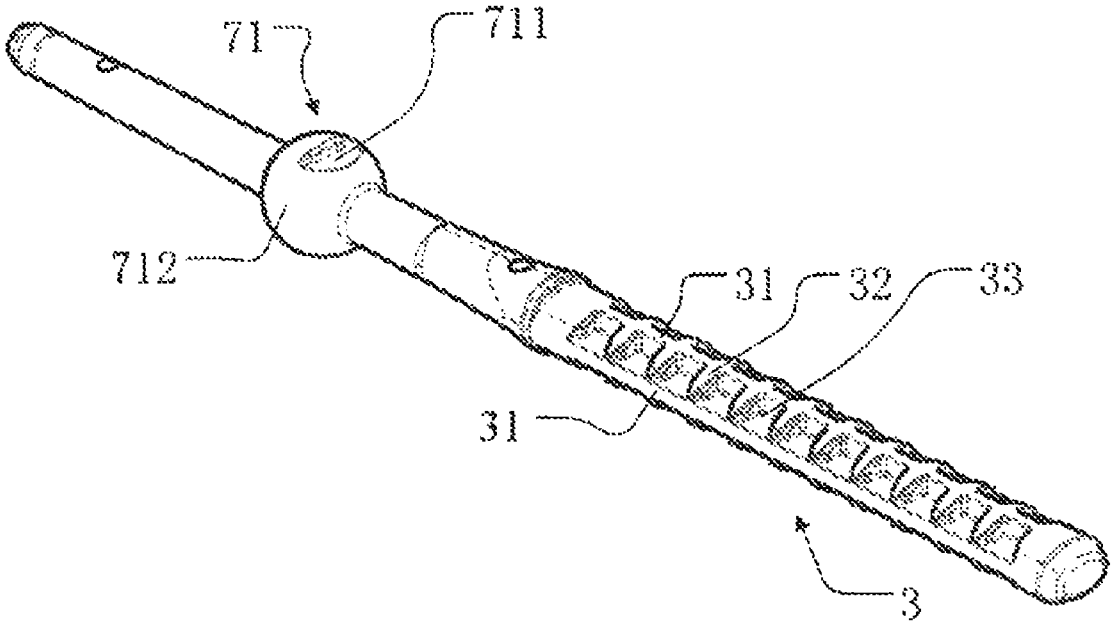
FIG. 16E shows a perspective view of a lever member in accordance with an embodiment of the present invention.

Specifically as shown in FIG. 16C, the spherical portion 71 comprises a substantively spherical surface 712 and a pair of substantially vertical planes 711. Accordingly, as shown in FIG. 18, the pivot sleeve 72 at its body 720 defines corresponding flat sections 721. Consequently, in addition or as an alternative to the aforesaid cooperation between the longitudinal ridges and engagement sides, the configuration of the planes and the flat sections allows to effectively reduce or eliminate any movement, such as the shaking in the horizontal direction, than the lever motion of lever member caused by the vertical movement of pull rod assembly, so as to improve operation stability of the linkage device 100.

Figure 18A:
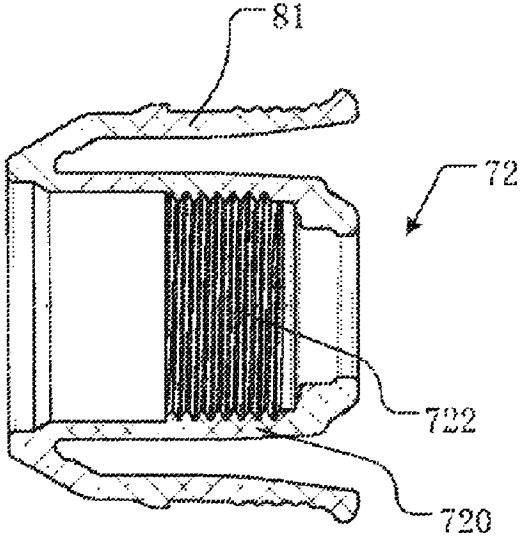
FIG. 18A shows a sectional view of a pivot sleeve in accordance with an embodiment of the present invention, being rotated for 90 degrees with respect to the mounting position so as to illustrate an elastic snapping means.
Figure 18B:
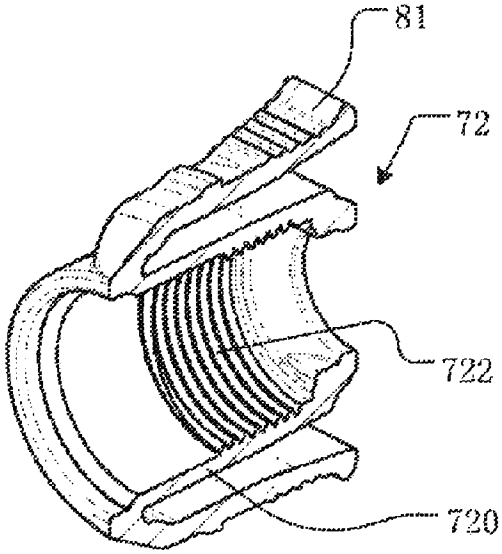
FIG. 18B shows a perspective view of the sectioned pivot sleeve as illustrated in FIG. 18A.
Figure 18C:
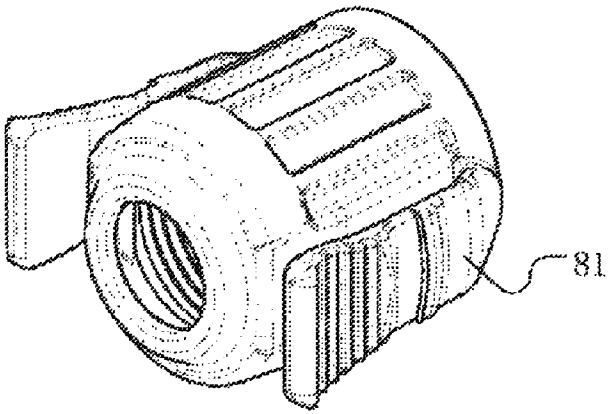
FIG. 18C shows a perspective view of a pivot sleeve in accordance with an embodiment of the present invention.
Figure 18D:
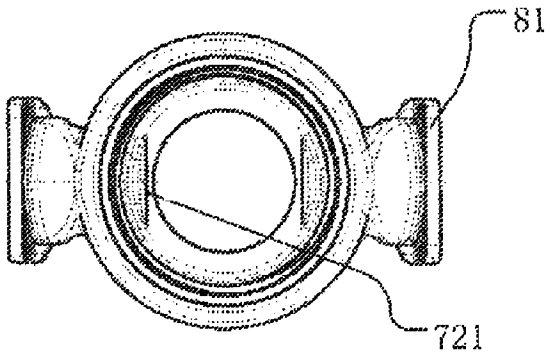
FIG. 18D shows an end view of a pivot sleeve in accordance with an embodiment of the present invention.

In particular as shown in FIGS. 6-9 and 18A-D, the elastically deformable snapping means 8 is in form of a pair of elastically deformable tabs 81, as cantilever beams, integrated with the pivot sleeve 72 of pivot assembly 7. To better illustrate the pair of elastically deformable tabs 81, the orientations of FIGS. 18A and 18B are turned for 90 degrees with respect to the mounting position of snapping means 8. As particularly shown in FIGS. 7, 8 and 10, the pair of elastically deformable tabs 81 each have a flange 811 and a press portion 812. Having formed threaded connection of the pivot assembly 7, the press portion 812 of elastically deformable tabs 81 may be pressed to reduce the radial dimension of the snapping means 8, such that the flange 811 may enter in the receiving port 51 of pipe body 5 and thus snap into the cut-out 511 of pipe body 5. The pivot assembly 7 is securedly assembled.

In the method of assembling the drain plug linkage assembly 100 according to the present invention, optionally the lever member 3 and link rod 2 may first be operatively connected with each other, and then the pivot assembly 7 is assembled into the receiving port 51 of pipe body 5, or vice versa, which falls within the scope of the present invention.

It shall be understood that although the present description is described in the respective embodiments, this does not mean one embodiment only covers one single solution. The specification is merely described in this way for the purpose of clear illustration, while the person skilled in the art shall take the specification as a whole, and is able to properly formulate the technical solution across the embodiments so as to form other embodiments that can be appreciated by the person skilled in the art. No single novel feature disclosed is not indispensable to all possible combinations, and each of the novel features can be combined with other prior arrangement to form new technical solutions, which all fall within the scope of the present invention.

The above are only exemplary embodiments of the present invention, and not for limiting the scope of the present invention. All the equivalent variations, modifications and combinations made within the spirit and scope of the invention by the person skilled in the art, shall fall within the claimed scope of the present invention.

LIST OF REFERENCE NUMERALS

1 - pull rod
2 - link rod
3 - lever member
4 - drain plug (rocket)
5 - pipe
6 - engagement mechanism
7 - pivot assembly
8 - snapping means
9 - pull rod connector
10 - pull rod assembly
11 - pull rod body
301 - second end
41 - aperture
42 - reinforcement rib
51 - receiving port
511 - cut-out
54 - positioning protrusion
59 - sealing member
60 - concave feature
61 - first engagement side
62 - second engagement side
12 - pull rod head
20 - receiving portion
21 - through-hole
22 - track
23 - stopping member
24 - receptacle
31 - vertically longitudinal ridge
32 - circumferential ridge
33 - recess
34 - horizontally longitudinal ridge
300 - first end -continued 63 - snapping protrusion
64 - first opening
65 - second opening
66 - longitudinal through-hole
661 - first guiding channel
662 - second guiding channel
71 - spherical portion
711 - plane
712 - spherical surface
72 - pivot sleeve
720 - sleeve body
721 - flat section
722 - pivot sleeve thread
73 - fastening sleeve
81 - elastically deformable tab
811 - flange
812 - press portion
100 - drain plug linkage device (drain device)

What is claimed is:

1. A drain plug linkage device, comprising:

a drain plug;

a pull rod assembly including a pull rod and a link rod operatively connected with each other;

a lever member having a first end operatively connected with the link rod, and a second end configured to operate the drain plug;

an engagement mechanism;

wherein the link rod comprises a plurality of through-holes and has the engagement mechanism slidably mounted thereon;

wherein the lever member is configured to be inserted through one of the plurality of through-holes and includes a plurality of axially-spaced circumferential ridges, a vertically longitudinal ridge and a horizontally longitudinal ridge, wherein a pair of top recesses are defined between adjacent circumferential ridges of the plurality of axially-spaced circumferential ridges; and wherein the engagement mechanism is configured, when sliding into a position of engaging with the pair of top recesses, to prevent the lever member from being axially displaced with respect to the through-hole through which the lever member is inserted.

2. The drain plug linkage device according to claim 1, wherein the plurality of through-holes each have a greater size than the first end of the lever member.

3. The drain plug linkage device according to claim 1, wherein the engagement mechanism comprises a rear wall, a front wall, two side walls, and a longitudinal through-hole defined by the rear wall, the front wall, and the side walls, wherein the link rod is configured to be inserted through the longitudinal through-hole.

4. The drain plug linkage device according to claim 3, wherein the rear wall comprises a first opening and the front wall comprises a second opening, and the rear wall is configured to engage into the pair of top recesses.

5. The drain plug linkage device according to claim 4, wherein the first opening of the rear wall defines a pair of first engagement sides with a first distance between the pair of first engagement sides, and a pair of second engagement sides with a second distance between the pair of second engagement sides, wherein the second distance is greater than the first distance.

6. The drain plug linkage device according to claim 5, wherein a pair of snapping protrusions is arranged at a lower portion of the pair of second engagement sides.

7. The drain plug linkage device according to claim 3, wherein the link rod has a pair of longitudinally arranged tracks, and the rear wall of the engagement mechanism forms a concave feature which defines a first guiding channel and a second guiding channel for receiving the pair of tracks in the longitudinal through-hole.

8. The drain plug linkage device according to claim 1, wherein the link rod comprises an elastic stopping member for preventing the engagement mechanism from being detached.

9. The drain plug linkage device according to claim 1, further comprising a pivot assembly comprising a sleeve means and a spherical portion pivotably arranged in the sleeve means, wherein the spherical portion is fixedly attached to or integral with the lever member between the first end and the second end of the lever member.

10. The drain plug linkage device according to claim 9, wherein the spherical portion has a pair of substantially vertical planes, and the sleeve means has corresponding flat sections.

11. The drain plug linkage device according to claim 9, further comprising an elastically deformable snapping means fixedly attached to or integral with the pivot assembly.

12. The drain plug linkage device according to claim 11, wherein the snapping means comprises a pair of elastically deformable tabs, each having a flange and a press portion.

13. The drain plug linkage device according to claim 1, wherein the vertically longitudinal ridge and the horizontally longitudinal ridge form a cross-shaped cross section such that a pair of bottom recesses are defined between adjacent circumferential ridges of the plurality of circumferential ridges.

* * * * *